US009989027B2

(12) United States Patent
Fitzner

(10) Patent No.: US 9,989,027 B2
(45) Date of Patent: Jun. 5, 2018

(54) HIGH PRESSURE PUMP HAVING LUBRICATING AND COOLING STRUCTURE

(71) Applicants: Hyundai Motor Europe Technical Center GmbH, Russelsheim (DE); Hyundai Motor Company, Seoul (KR); Kia Motors Corporation, Seoul (KR)

(72) Inventor: Stephan Fitzner, Echzell (DE)

(73) Assignees: Hyundai Motor Europe Technical Center GmbH, Russelsheim (DE); Hyundai Motor Company, Seoul (KR); Kia Motors Corporation, Seoul (KR)

( * ) Notice: Subject to any disclaimer, the term of this patent is extended or adjusted under 35 U.S.C. 154(b) by 270 days.

(21) Appl. No.: 14/935,383

(22) Filed: Nov. 7, 2015

(65) Prior Publication Data

US 2017/0030314 A1 Feb. 2, 2017

(30) Foreign Application Priority Data

Jul. 29, 2015 (KR) ..... 10-2015-0107561

(51) Int. Cl.
*F02M 59/44* (2006.01)
*F02M 63/00* (2006.01)
(Continued)

(52) U.S. Cl.
CPC ..... *F02M 59/44* (2013.01); *F02M 59/027* (2013.01); *F02M 59/102* (2013.01);
(Continued)

(58) Field of Classification Search
CPC .... F02M 59/44; F02M 59/027; F02M 59/442; F02M 59/102; F02M 9/10;
(Continued)

(56) References Cited

U.S. PATENT DOCUMENTS 3,476,451 A * 11/1969 Schwartzman ..... F16C 32/0622 384/110
4,298,318 A * 11/1981 Tsuchiya ..... F01C 1/104 137/625.21
(Continued)

FOREIGN PATENT DOCUMENTS

DE 955100 C 12/1956
DE 19729793 A1 1/1999
(Continued)

OTHER PUBLICATIONS

European Search Report for European Patent Application No. 15193365.2, dated Nov. 28, 2016, 6 pages.

*Primary Examiner* — Bryan Lettman
*Assistant Examiner* — Stephen Mick
(74) *Attorney, Agent, or Firm* — Mintz Levin Cohn Ferris Glovsky and Popeo, P.C.; Peter F. Corless

(57) ABSTRACT

A high pressure pump is provided to be used in a fuel feeding system for a vehicle engine and receive a fuel primarily pressurized by a low pressure pump, and secondarily compresses the fuel to increase the pressure of the fuel for supplying the fuel to a fuel injector. The high pressure pump includes a pump body and a camshaft that is rotatably installed in the pump body to be rotated using torque transmitted from an exterior of the pump body. Additionally, a roller bearing rotatably supports the camshaft in the pump body and an inlet port is disposed on the pump body to introduce a primarily pressurized fluid into the pump body. An orifice is configured to supply the fluid to the roller bearing while reducing a pressure of the fluid introduced via the inlet port.

8 Claims, 6 Drawing Sheets

(51) Int. Cl.

| | |
|---|---|
| ***F02M 59/10*** | (2006.01) |
| ***F02M 59/02*** | (2006.01) |
| ***F04B 9/04*** | (2006.01) |
| ***F04B 53/08*** | (2006.01) |
| ***F04B 53/14*** | (2006.01) |
| ***F04B 53/16*** | (2006.01) |
| ***F04B 53/18*** | (2006.01) |

(52) U.S. Cl.
CPC ..... *F02M 59/442* (2013.01); *F02M 63/0001* (2013.01); *F04B 9/042* (2013.01); *F04B 53/08* (2013.01); *F04B 53/14* (2013.01); *F04B 53/16* (2013.01); *F04B 53/18* (2013.01)

(58) Field of Classification Search
CPC ..... F02M 63/0001; F04B 53/08; F04B 9/042; F04B 53/18; F04B 53/14; F04B 53/16; F16C 33/66
USPC ..... 417/437
See application file for complete search history.

(56) References Cited

U.S. PATENT DOCUMENTS

| | | | | |
|---|---|---|---|---|
| 4,325,589 | A | 4/1982 | Hirt | |
| 5,417,556 | A * | 5/1995 | Waddleton | F04C 15/0026 418/132 |
| 2005/0241880 | A1* | 11/2005 | Nawamoto | B23Q 1/70 184/6 |
| 2010/0202720 | A1* | 8/2010 | Kobayashi | B23Q 11/122 384/474 |
| 2011/0064344 | A1* | 3/2011 | Shibagaki | F16C 33/664 384/462 |
| 2013/0167957 | A1 | 7/2013 | Rajput et al. | |
| 2014/0356123 | A1* | 12/2014 | Gerber | F04D 29/06 415/1 |

FOREIGN PATENT DOCUMENTS

| | | | |
|---|---|---|---|
| DE | 19906839 | A1 | 8/2000 |
| EP | 1039121 | A2 | 9/2000 |
| JP | S62-026372 | A | 2/1987 |
| JP | 2003-172231 | A | 6/2003 |
| JP | 2004-270647 | A | 9/2004 |
| KR | 10-2000-0076206 | | 12/2000 |
| KR | 10-2001-0015122 | | 2/2001 |
| KR | 10-2010-0074841 | | 7/2010 |
| KR | 10-1439038 | B1 | 9/2014 |

* cited by examiner

HIGH PRESSURE PUMP HAVING LUBRICATING AND COOLING STRUCTURE

CROSS REFERENCE TO RELATED APPLICATION

The present application claims priority to Korean Patent Application No. 10-2015-0107561, filed Jul. 29, 2015, the entire contents of which is incorporated herein for all purposes by this reference.

BACKGROUND

Field of the Invention

The present invention generally relates to a high pressure pump, and more particularly, to the structure of a pump that secondarily compresses a primarily pressurized fluid introduced thereinto.

Description of the Related Art

A high pressure pump used in a fuel feeding system for a vehicle engine receives a fuel pressurized primarily by a low pressure pump. The high pressure pump secondarily compresses the fuel to increase the pressure of the fuel for supplying the fuel to a fuel injector, thereby realizing improved fuel combustibility in the vehicle engine. Such a high pressure pump should have as low volume and light weight feature. In addition, the high pressure pump should also allow a low pressure pump to supply a fuel by minimally compressing the fuel, and to ensure efficient operation and sufficient durability.

The foregoing is intended merely to aid in the understanding of the background of the present invention, and is not intended to mean that the present invention falls within the purview of the related art that is already known to those skilled in the art.

SUMMARY

Accordingly, the present invention provides a high pressure pump having a lubricating and cooling structure, so that the high pressure pump has minimal volume and weight. Additionally, the high pressure pump allows a low pressure pump to supply a fuel by minimally compressing the fuel to ensure efficient operation and sufficient durability.

According to one aspect of the present invention, a high pressure pump may include: a pump body; a camshaft rotatably installed in the pump body to be rotated using torque transmitted from an exterior of the pump body; a roller bearing rotatably supporting the camshaft in the pump body; an inlet port disposed on the pump body to introduce a primarily pressurized fluid into the pump body; and an orifice configured to supply the fluid to the roller bearing while reducing a pressure of the fluid introduced via the inlet port.

In the high pressure pump, an outlet port may be disposed on the pump body to discharge the fluid that passes through the roller bearing from the orifice; and an outlet conduit may extend from the roller bearing to the outlet port and may function as a flowing conduit of the fluid, the outlet conduit being configured to change a direction thereof several times at a location around the roller bearing, thereby contributing to cooling of the high pressure pump. The inlet port and the outlet port may be disposed at opposite positions based on the camshaft to face each other; and the inlet conduit and the outlet conduit may be symmetrically arranged based on the roller bearing, in which the inlet conduit may lead the fluid from the inlet port to the roller bearing and the outlet conduit may lead the fluid from the roller bearing to the outlet port.

The inlet conduit leading the fluid from the inlet port to the roller bearing may be configured to lead the fluid to the roller bearing after reciprocating while passing at least one time around a part of the pump body proximate to (e.g., disposed next to) the camshaft based on the camshaft, so that the fluid cools the high pressure pump. The inlet port may be disposed on an upper part of the pump body at a location opposite to the outlet port based on the camshaft; and the inlet conduit may include: a first part that extends from the inlet port to a lower part of the pump body based on the camshaft; a second part that extends from the first part in a lengthwise direction of the camshaft; a third part that extends upward from the second part; a fourth part that extends from the third part to a position over the roller bearing; and a fifth part that extends downward from the fourth part to the roller bearing.

The orifice may be disposed at a junction of the fourth part and the fifth part of the inlet conduit. The inlet conduit may further include a sixth part that extends from the second part to a high pressure pumping unit to supply the fluid to the high pressure pumping unit. The high pressure pumping unit may be configured to pump the fluid at a high pressure by using torque of the camshaft inside the pump body. The high pressure pump may further include a direct port disposed in the pump body to directly supply a fluid to be highly pressurized from the exterior of the pump body to the high pressure pumping unit so that the direct port supplies the fluid to be highly pressurized to the high pressure pumping unit. Additionally, the high pressure pumping unit may be configured to pump the fluid at a high pressure using torque of the camshaft inside the pump body, and the fluid to be highly pressurized may be different from the fluid introduced via the inlet port.

The outlet port may be disposed on the upper part of the pump body at a location opposite to the inlet port based on the camshaft; and the outlet conduit may include: an A part that extends to a position under the roller bearing; a B part that extends from the A part in a direction toward the outlet port while being perpendicular to the camshaft; a C part that extends from the B part in a direction toward the outlet port along the lengthwise direction of the camshaft; and a D part that extends from the C part to the outlet port.

The outlet conduit may further include an E part that extends from a junction of the A part and the B part of the outlet conduit in a direction opposite the extending direction of the B part. The inlet conduit and the outlet conduit may include a plurality of rectilinear conduits perpendicular to or parallel with the lengthwise direction of the camshaft inside the pump body that are connected together while encircling an area at which the camshaft is installed.

Since the high pressure pump of the present invention may have a lubricating and cooling structure, it may have a minimal volume and weight, and the high pressure pump allows a low pressure pump, which supplies a fluid to be additionally pressurized, to supply the fluid by minimally compressing the fluid, and to ensure efficient operation and sufficient durability. Furthermore, since energy consumed in driving the low pressure pump is decreased, the carbon dioxide ($CO_2$) exhaust may be decreased, and an expense spent in driving the low pressure pump may be reduced.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION

Figure 1:
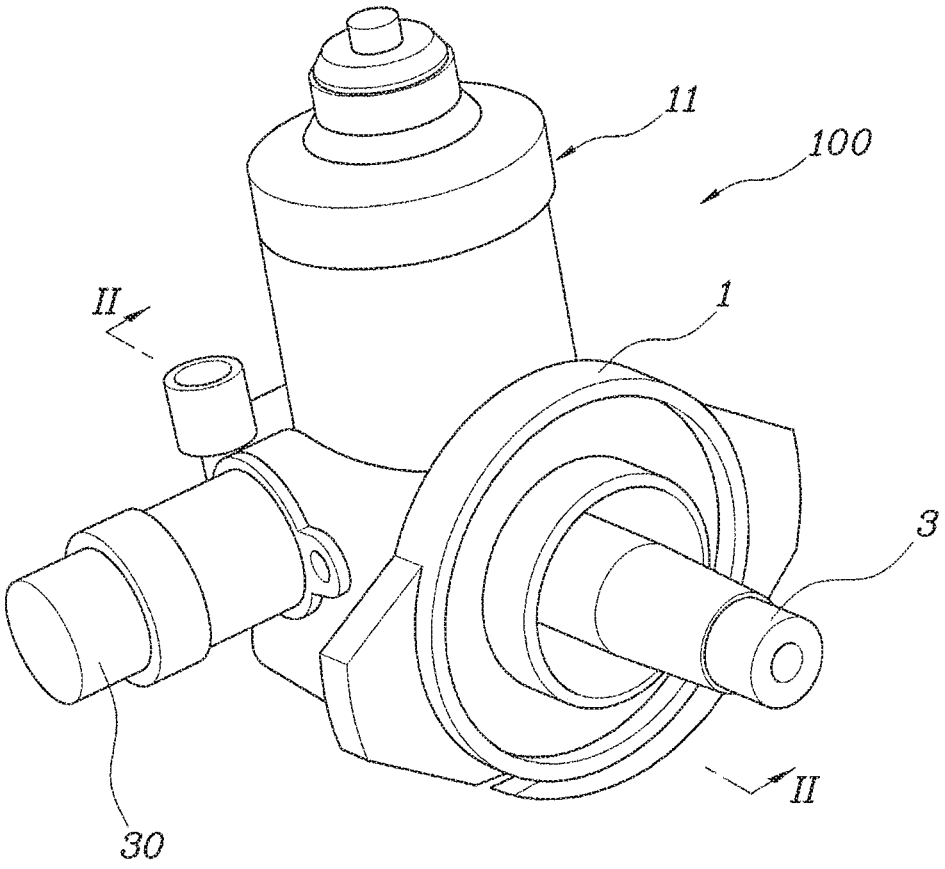
FIG. 1 is a view showing the appearance of a high pressure pump according to an exemplary embodiment of the present invention.
Figure 2:
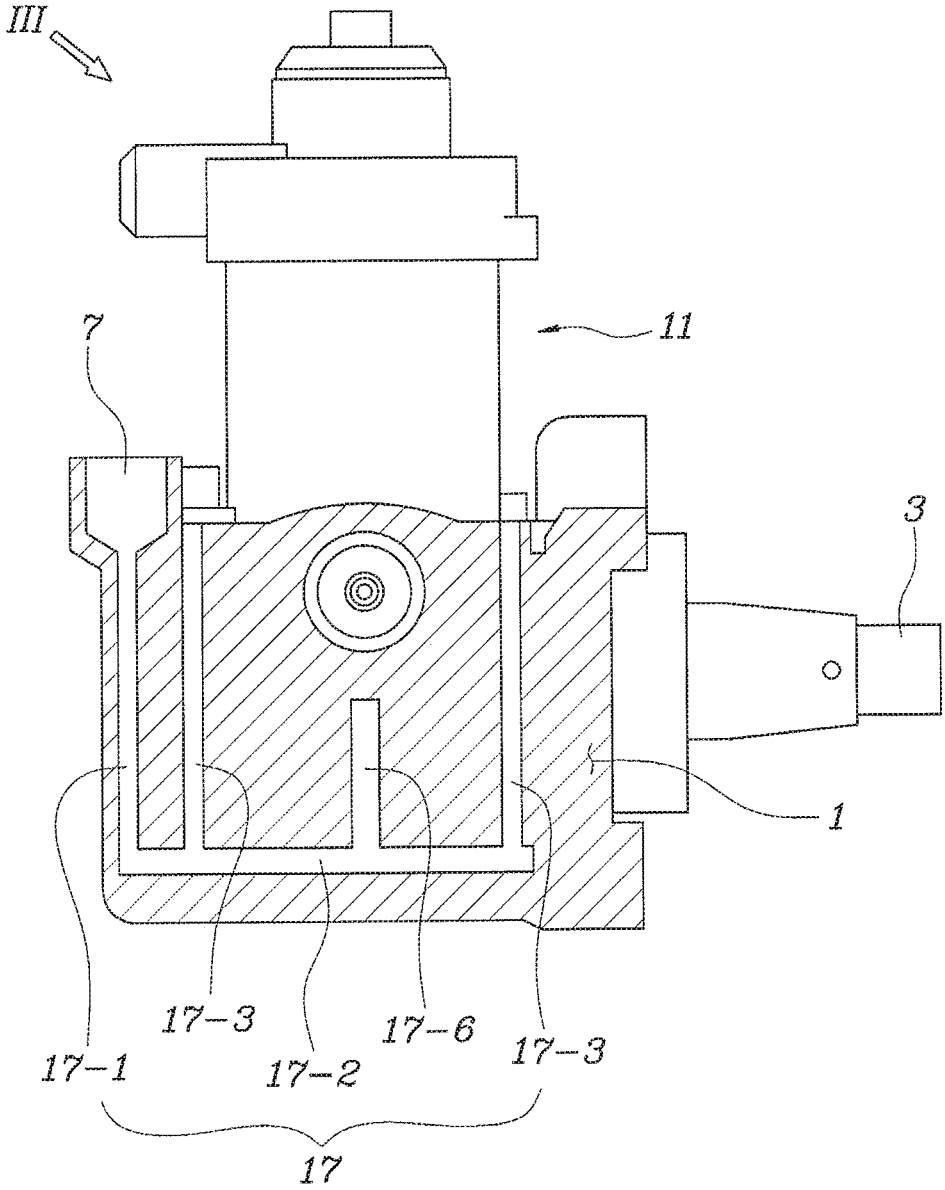
FIG. 2 is a sectional view taken along line II-II of FIG. 1 according to an exemplary embodiment of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Hereinbelow, exemplary embodiments of the present invention will be described in detail with reference to the accompanying drawings. Throughout the drawings, the same reference numerals will refer to the same or like parts.

Retelling to FIGS. 1 to 5, a high pressure pump of the present invention may include a pump body 1; a camshaft 3 rotatably installed in the pump body to be rotated using torque transmitted from an exterior of the pump body; a roller bearing 5 rotatably supporting the camshaft in the pump body; an inlet port 7 disposed on the pump body to introduce a primarily pressurized fluid into the pump body; and an orifice 9 configured to supply the fluid to the roller bearing while reducing a pressure of the fluid introduced via the inlet port.

The camshaft 3 may include a cam (not shown), and a high pressure pumping unit 11 configured to compress a fluid at a high pressure in response to a reciprocation of a plunger actuated by the cam. The configuration of the high pressure pumping unit is well-known to those skilled in the art, and a further explanation thereof is therefore omitted. For reference, a "fluid" described in the present invention is a concept including a fuel, and unless stated otherwise, the fluid refers to a fuel supplied to the high pressure pump after primarily pressurizing the fuel in a low pressure pump, and the high pressure pump secondarily compresses the fuel at a high pressure and collaterally uses the fuel to cool and lubricate the roller bearing.

In the high pressure pump of the present invention, the roller bearing 5 may be configured to support the camshaft 3, to allow the structure rotatably supporting the camshaft to be sufficiently lubricated even with a lower pressure than the pressure used when using a plain bearing. Though it is essential that the plain bearing be provided with a fluid of relatively high pressure to form a fluid layer therein, a roller bearing may operate even when provided with a fluid of relatively low pressure while the fluid forms a regular flowing motion.

Accordingly, when the high pressure pump of the present invention is used, a low pressure pump (not shown) supplying a primarily pressurized fluid to the high pressure pump 100 may offer a lower pressure than the pressure used in the case of lubricating a plain bearing, and thus the volume or size of the low pressure pump may be decreased, thereby realizing a less expensive low pressure system.

The high pressure pump 11 of the present invention may be configured to supply a fluid provided from the low pressure pump to the roller bearing in the form of a regular flowing motion by reducing the pressure of the fluid via the orifice. In the high pressure pump 11, an outlet port 13 may be disposed on the pump body to discharge the fluid that passes through the roller bearing from the orifice 9, and an outlet conduit 15, which functions as a flowing conduit for the fluid and extends from the roller bearing to the outlet port, may be configured to change the extending direction thereof several times at a location around the roller bearing 5, thereby contributing to cooling of the high pressure pump. Accordingly, the cooling of heat generated by the operation of the high pressure pump may be maximized by the fluid passing through the outlet conduit 15.

The inlet port 7 and the outlet port 13 may be disposed at opposite positions based on the camshaft to face each other. The inlet conduit 17 and the outlet conduit 15 may be arranged symmetrically based on the roller bearing, in which the inlet conduit leads the fluid from the inlet port to the roller bearing, and the outlet conduit leads the fluid from the roller bearing to the outlet port. Furthermore, a plurality of rectilinear conduits perpendicular to or parallel with a lengthwise direction of the camshaft inside the pump body may be connected together while encircling an area at which the camshaft is installed.

Figure 3:
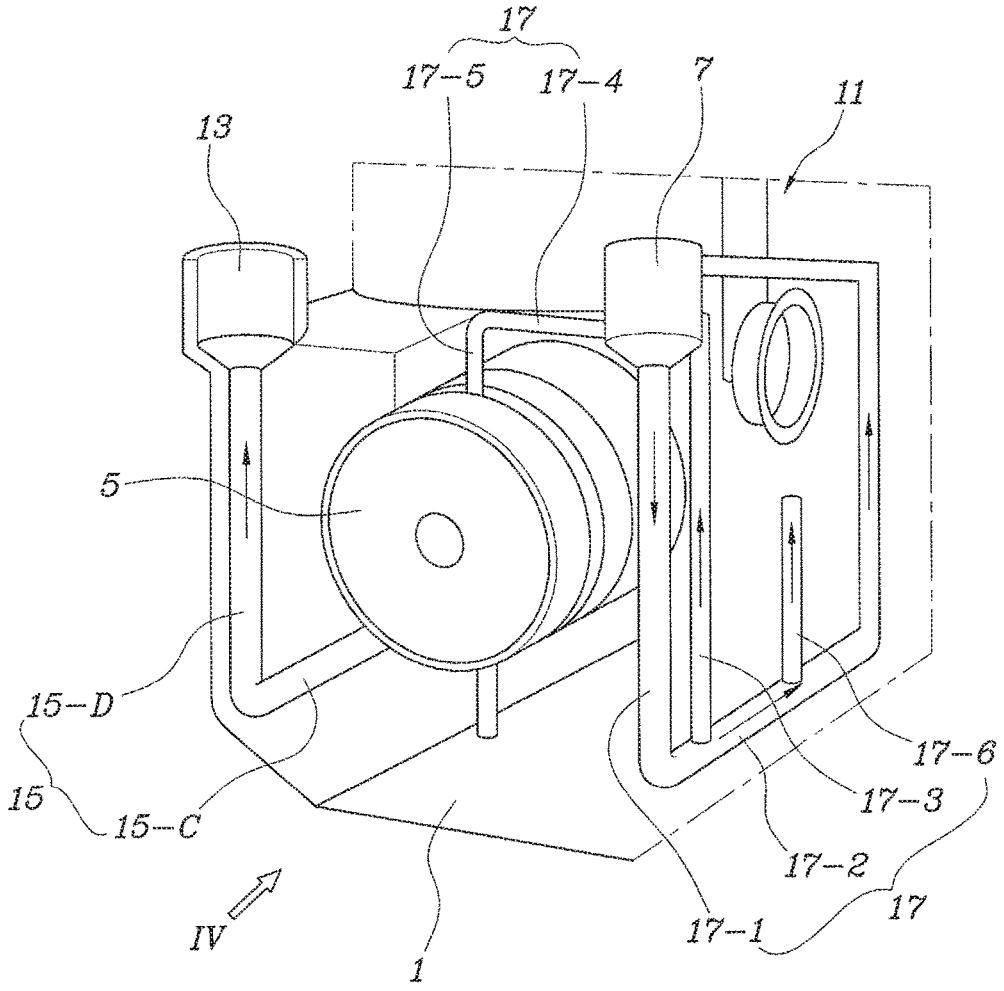
FIG. 3 is a view shown from direction III of FIG. 2 according to an exemplary embodiment of the present invention.
Figure 4:
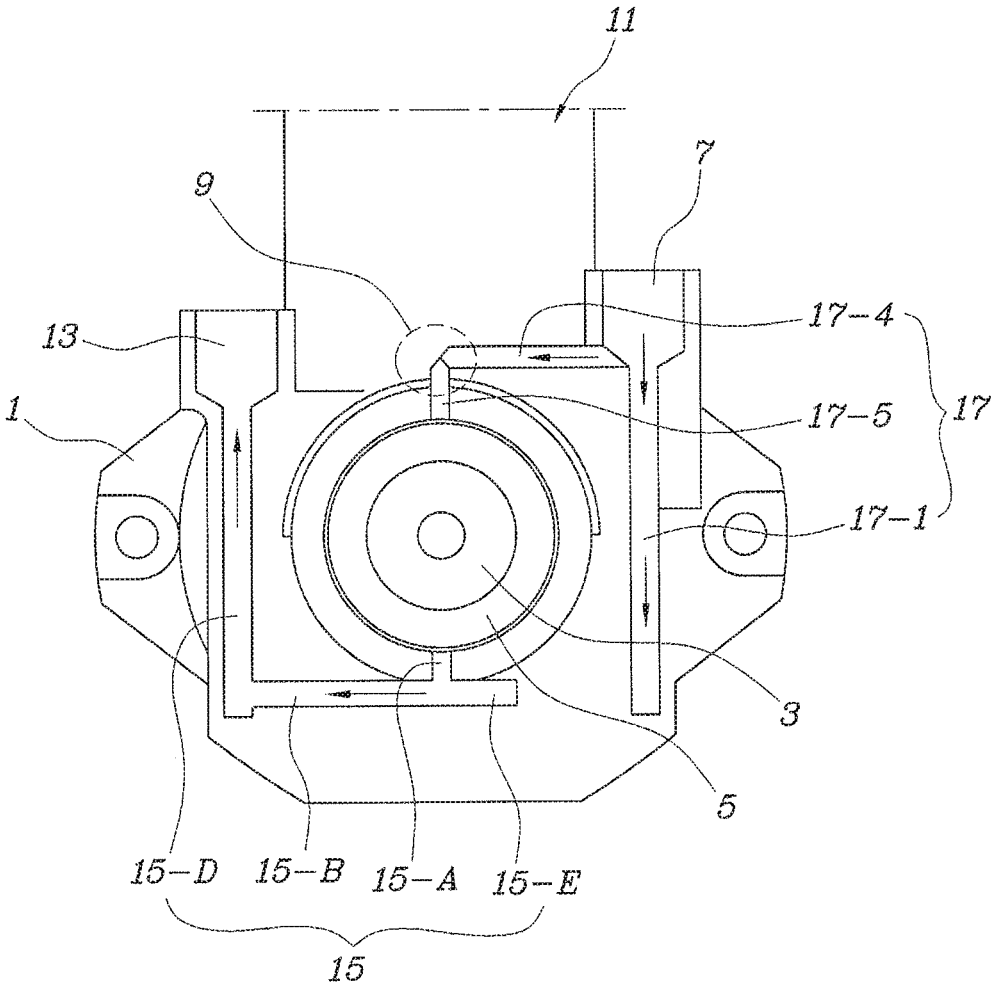
FIG. 4 is a view shown from direction IV of FIG. 3 according to an exemplary embodiment of the present invention.
Figure 5:
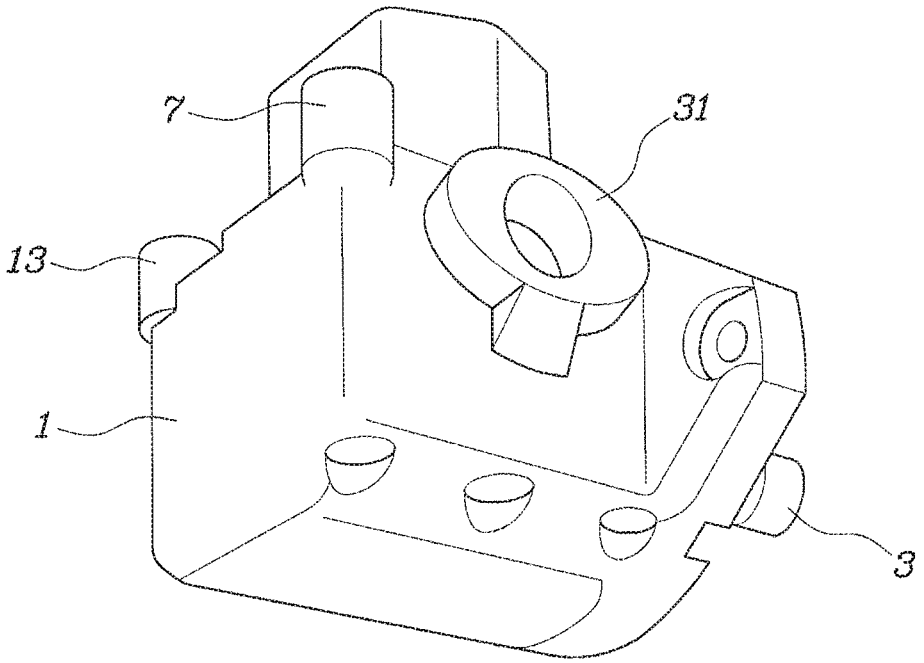
FIG. 5 is a view shown from a lower position in FIG. 1, with a sensor unit removed from the high pressure pump of FIG. 1 according to an exemplary embodiment of the present invention.

Accordingly, the inlet conduit and the outlet conduit may be formed in the pump body 1 by drilling or another similar method. Due to the inlet conduit and the outlet conduit rectilinearly connected at locations around the camshaft, the pump body may have low volume and minimized weight. The inlet conduit 17 leading the fluid from the inlet port to the roller bearing may be configured in such a manner that the inlet conduit leads the fluid to the roller bearing after reciprocating while passing at least one time around a part of the pump body proximate to the camshaft based on the camshaft, to allow the fluid to efficiently cool the high pressure pump. For reference, the first part 17-1 and the third part 17-3 of FIG. 3 are constituted to reciprocate one time while passing around a part of the pump body 1 proximate to the camshaft 3. In other words, a substantial amount of heat may be generated around a camshaft 3 of the high pressure pump 100. When the inlet conduit is disposed around a part of the pump body proximate to the camshaft such that the inlet conduit reciprocates, the fluid that passes through the inlet conduit may increase the effect of cooling the pump body.

In an exemplary embodiment of the present invention, the inlet port 7 may be disposed on an upper part of the pump body at a location opposite to the outlet port 13 based on the camshaft, and the inlet conduit 17 may include: a first part 17-1 that extends from the inlet port to a lower part of the pump body based on the camshaft; a second part 17-2 that extends from the first part in a lengthwise direction of the camshaft; a third part 17-3 that extends upward from the second part; a fourth part 17-4 that extends from the third part to a position over the roller bearing; and a fifth part 17-5 that extends downward from the fourth part to the roller bearing.

In addition, the orifice 9 may be disposed at a junction of the fourth part 17-4 and the fifth part 17-5 of the inlet conduit. Additionally, the orifice may be disposed at a junction of the fourth part 17-4 and the fifth part 17-5 by drilling or a similar method. The inlet conduit may include a sixth part 17-6 that extends from the second part 17-2 to a high pressure pumping unit to supply the fluid to the high pressure pumping unit 11, the high pressure pumping unit functioning to pump the fluid at a high pressure using torque of the camshaft inside the pump body 1.

In other words, as illustrated in FIGS. 1 to 5, the fluid supplied from a low pressure pump is a fuel, and the fuel may lubricate and cool the roller bearing, and the fuel passing through both the inlet conduit and the outlet conduit removes heat generated by the operation of the high pressure pump. Further, the fuel may be supplied to the high pressure pumping unit via the sixth part, and may be secondarily compressed at a high pressure for an engine to use the fuel.

The outlet port 13 may be on an upper part of the pump body at a location opposite to the inlet port 7 based on the camshaft, and the outlet conduit 15 may include: an A part 15-A that extends to a position under the roller bearing; a B part 15-B that extends from the A part in a direction toward the outlet port while being perpendicular to the camshaft; a C part 15-C that extends from the B part in a direction toward the outlet port along a lengthwise direction of the camshaft; and a D part 15-D that extends from the C part to the outlet port.

In other words, though the outlet conduit may be configured to rectilinearly extend from the roller bearing to the outlet port, the outlet conduit may change a direction thereof several times through the A part, B part, C part, and D part thereof at a location around the roller bearing, thereby prolonging the flowing distance of fluid and contributing to the cooling of the pump body so that the outlet conduit may contribute to efficiently cooling of the high pressure pump. Additionally, the outlet conduit may further include an E part 15-E that extends from a junction of the A part and the B part of the outlet conduit in a direction opposite the extending direction of the B part, to allow cooling around the roller bearing to be performed more evenly.

Figure 6:
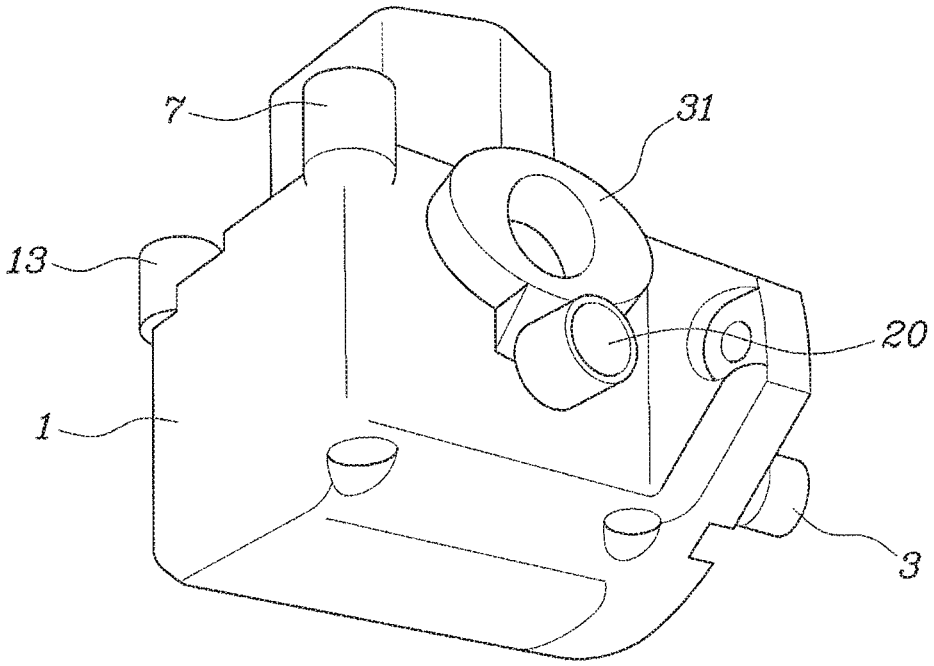
FIG. 6 is a view showing a high pressure pump according to another exemplary embodiment of the present invention shown from the same direction as FIG. 5.

As illustrated in FIG. 6, as a second exemplary embodiment of the present invention, the fluid supplied to the high pressure pump may include a fuel to be pressurized at a high pressure by the pump and oil for lubricating and cooling the high pressure pump. In other words, the high pressure pump may further include a direct port 20 disposed in the pump body to directly supply a fluid to be highly pressurized from the exterior of the pump body to the high pressure pumping unit to allow the direct port to supply the fluid to be highly pressurized to the high pressure pumping unit, wherein the high pressure pumping unit may be configured to pump the fluid at a high pressure using torque of the camshaft inside the pump body. Particularly, the fluid to be highly pressurized may be different from the fluid introduced via the inlet port.

Accordingly, in this second exemplary embodiment, oil may be introduced into the inlet port, and the oil may pass through the inlet conduit, the roller bearing, and the outlet conduit, and may be discharged through the outlet port. In addition, the sixth part of the inlet conduit of the first exemplary embodiment is not provided unlike the first exemplary embodiment, but instead the direct port may be disposed on the high pressure pump to separately supply a fuel to the high pressure pumping unit.

Of course, the inlet port, the inlet conduit, the outlet conduit, the outlet port, the orifice, and the lubricating structure for the roller bearing, etc. of the second exemplary embodiment remain the same as those of the first exemplary embodiment of FIGS. 1 to 5, but the only different constitution is that as described above, the sixth part of the inlet conduit may be replaced with the direct port. The reference numeral 30 of FIG. 1 denotes a sensor unit (e.g., a sensor) configured to measure a physical quantity within the high pressure pump, and 31 of FIGS. 5 and 6 denotes a socket unit to which the sensor unit may be mounted.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A high pressure pump, comprising:

a pump body;

a camshaft rotatably installed in the pump body to be rotated using torque transmitted from an exterior of the pump body;

a roller bearing rotatably supporting the camshaft in the pump body;

an inlet port disposed on the pump body to introduce a primarily pressurized fluid into the pump body; and an orifice configured to supply the fluid to the roller bearing while reducing a pressure of the fluid introduced via the inlet port, wherein an outlet port is disposed on the pump body to discharge the fluid that passes through the roller bearing from the orifice; and an outlet conduit extends from the roller bearing to the outlet port and functions as a flowing conduit of the fluid, the outlet conduit being configured to change a direction thereof multiple times at a location around the roller bearing, to cool the high pressure pump, wherein the inlet port and the outlet port are disposed at opposite positions with respect to the camshaft to face each other; and the inlet conduit and the outlet conduit are arranged symmetrically with respect to the roller bearing, in which the inlet conduit leads the fluid from the inlet port to the roller bearing and the outlet conduit leads the fluid from the roller bearing to the outlet port, and wherein the outlet port is disposed on an upper part of the pump body at a location opposite to the inlet port with respect to the camshaft; and the outlet conduit comprises: an A part that extends to a position under the roller bearing; a B part that extends from the A part in a direction toward the outlet port while being perpendicular to the camshaft; a C part that extends from the B part in a direction toward the outlet or along a lengthwise direction of the camshaft; and a D part that extends from the C part to the outlet port.

2. The high pressure pump of claim 1, wherein the inlet conduit leads the fluid to the roller bearing after allowing the fluid to reciprocate while passing at least one time around a part of the pump body proximate to the camshaft with respect to the camshaft, to cause the fluid to cool the high pressure pump.

3. The high pressure pump of claim 2, wherein the inlet port is disposed on an upper part of the pump body at a location opposite to the outlet port with respect to the camshaft, and the inlet conduit comprises:

a first part that extends from the inlet port to a lower part of the pump body with respect to the camshaft;

a second part that extends from the first part in a lengthwise direction of the camshaft;

a third part that extends upward from the second part;

a fourth part that extends from the third part to a position over the roller bearing; and a fifth part that extends downward from the fourth part to the roller bearing.

4. The high pressure pump of claim 3, wherein the orifice is disposed at a junction of the fourth part and the fifth part of the inlet conduit.

5. The high pressure pump of claim 4, wherein the inlet conduit further comprises:

a sixth part that extends from the second part to a high pressure pumping unit to supply the fluid to the high pressure pumping unit, the high pressure pumping unit configured to pump the fluid at a high pressure using torque of the camshaft inside the pump body.

6. The high pressure pump of claim 4, further comprising:

a direct port disposed in the pump body to directly supply a separate fluid to be highly pressurized from the exterior of the pump body to a high pressure pumping unit to cause the direct port to supply the separate fluid to be highly pressurized to the high pressure pumping unit, wherein the high pressure pumping unit is configured to pump the separate fluid at a high pressure using torque of the camshaft inside the pump body, and wherein the separate fluid to be highly pressurized is different from the fluid introduced via the inlet port.

7. The high pressure pump of claim 1, wherein the outlet conduit further comprises:

an E part that extends from a junction of the A part and the B part of the outlet conduit in a direction opposite the extending direction of the B part.

8. The high pressure pump of claim 1, wherein a plurality of rectilinear conduits perpendicular to or parallel with a lengthwise direction of the camshaft inside the pump body are connected together while encircling an area at which the camshaft is installed.

* * * * *